US007311318B1

(12) United States Patent
Funk

(10) Patent No.: US 7,311,318 B1
(45) Date of Patent: Dec. 25, 2007

(54) TROUGHED SKATEBOARD WHEELS

(76) Inventor: Shelby A. Funk, 7660 Timberrose Way, Roseville, CA (US) 95747

( * ) Notice: Subject to any disclaimer, the term of this patent is extended or adjusted under 35 U.S.C. 154(b) by 0 days.

(21) Appl. No.: 11/454,391

(22) Filed: Jun. 15, 2006

(51) Int. Cl.
*B62M 1/00* (2006.01)

(52) U.S. Cl. ..... 280/87.042; 301/5.3; 301/5.7

(58) Field of Classification Search ..... 280/87.042, 280/11.233, 11.24, 11.27, 11.19, 11.28, 11.25, 280/11.221, 11.223, 11.227; 301/5.3, 5.7
See application file for complete search history.

(56) References Cited

U.S. PATENT DOCUMENTS 3,912,332 A * 10/1975 Jones ..... 301/5.7
3,915,774 A * 10/1975 Dobson ..... 156/113
4,047,727 A * 9/1977 Holladay et al. ..... 280/87.042
4,130,320 A * 12/1978 Scardenzan ..... 301/5.7
D299,733 S * 2/1989 Taminich ..... D21/779
4,805,934 A * 2/1989 Mullenax ..... 280/7.12
5,411,320 A * 5/1995 Alderman et al. ..... 301/5.302
6,290,242 B1 * 9/2001 Ludwig ..... 280/11.233
6,322,154 B1 * 11/2001 Alderman et al. ..... 301/5.303
6,578,930 B1 * 6/2003 Alderman et al. ..... 301/5.303
6,598,919 B2 * 7/2003 Bradley et al. ..... 295/1
6,698,776 B2 * 3/2004 Todd ..... 280/87.042
6,953,225 B2 * 10/2005 Gallagher et al. ..... 301/5.308
6,991,296 B2 * 1/2006 Back ..... 301/5.301
7,004,504 B1 * 2/2006 Paulovits, Jr. ..... 280/809

OTHER PUBLICATIONS

KRYPTONICS; Kryptonics Wheels for Longboards and Old School Skateboards; Krypto and Krypgrip Longboard Wheels; http://www.skatesonhaight.com internet website; Mar. 15, 2005.
ABEC 11; Abec 11 Wheels for New School Skateboards, Old School Skateboards and Longboards; Flashback, No Schools and Striker Longboard and Skateboard Wheels; http://www.skatesonhaight.com internet website; Mar. 15, 2005.
SECTOR 9; Sector 9 Wheels for New School Skateboards, Old School Skateboards and Longboards; Nineball Longboard and Skateboard Wheels; http://www.skatesonhaight.com internet website; Mar. 15, 2005.
FLIP; Flip Wheels; Birdhouse, Chevron Repeaters and Hell on Wheels Skateboard Wheels; http://www.skatesonhaight.com internet website; Mar. 15, 2005.
SPITFIRE; Spitfire Wheels for Skateboards; Billy Marks, Dan Drehobl, Stacked, Crucifire, High Evil, Hardline Inthinities, Admiral, Barfly, Charred Remains, Multiball, Hardline Thins, Trophies and Xeroxide Skateboard Wheels; http://skatesonhaight.com internet website; Mar. 15, 2005.

(Continued)

*Primary Examiner*—J. A Shriver
(74) *Attorney, Agent, or Firm*—Heisler & Associates

(57) ABSTRACT

A wheel is provided for a conveyance such as a skateboard. The wheel is generally cylindrical in form with a tread surface defining a portion of the wheel adapted to contact an underlying surface upon which the wheel is rotatably supported. The tread surface includes a circumferential trough therein dividing the tread surface into a pair of crests circumscribing the wheel on each side of the trough.

3 Claims, 1 Drawing Sheet

OTHER PUBLICATIONS

Powell Wheels; Powell Wheels—The Widest Range of Sizes and Hardnesses for any Skateboarding Style; Oval, Skull & Sword, Ripper, Mini Logo 2, AT-80, Bombers, G Bones, Soft Cores, SPF, Pro Wheels, Bowl Bomber, Bowl Rider and Mini Logo 3 Skate board Wheels; http://www.skatesonhaight.com internet website; Mar. 15, 2005.

Pig Wheels; Pig Wheels for Skateboards; Natural, Duffel, Pig Head, Multi and Aircore Skateboard Wheels; http://www.skatesonhaight.com internet website; Mar. 15, 2005.

* cited by examiner

TROUGHED SKATEBOARD WHEELS

FIELD OF THE INVENTION

The following invention relates to wheels of the type used to rollingly support a skateboard or similar conveyance upon a surface. More particularly, this invention relates to wheels which include a circumferential trough therein for enhanced wheel performance.

BACKGROUND OF THE INVENTION

Skateboarding has established itself as a sport of exceptional popularity. While skateboards have been provided with various different configurations, most common standard skateboards include a generally flat board supported upon wheels. Most typically, forward and rearward trucks are attached to an underside of the board with a pair of wheels rotatably supported by each of the trucks. The trucks typically have a form of resilient coupler which allows the board to pivot relative to a plane in which the two wheels supported by the truck are supported. Hence, the board can be angled away from horizontal somewhat while keeping all of the four wheels rolling upon the ground. Such angling of the board also turns the wheels for directional control of the skateboard.

The wheels provided with the skateboard can have different configurations, and can be formed from different materials. However, most commonly skateboard wheels are made of a solid urethane material with a generally cylindrical form. This cylindrical form is defined by an inner side surface and an outer side surface which are generally circular and a tread surface therebetween which is generally cylindrical. A central axis of the wheel typically has a hollow bore passing therethrough which allows the wheels to be mounted to an axle supported by the truck. The wheels can either rotate upon the axle, generally acting in the form of a journal bearing, or can have a roller bearing fitted within the wheel with an inner race coupled to the axle and an outer race coupled to the wheel with the two races rolling relative to each other.

Most typically the urethane from which the wheels are formed has a hardness on the durometer "a" scale of between 75 and 103. Diameters for prior art skateboard wheels generally vary between about 50 millimeters and 77 millimeters. The softer urethanes generally provide greater traction and are most suitable where maneuverability is at a premium. Urethane wheels having a greater hardness are generally more desirable where greater speed is desired and where it is desirable that the wheels have longer endurance. Typical skateboard wheels have a width of generally between about 30 millimeters and 40 millimeters.

Also, skateboard wheels of the prior art vary somewhat in the degree of roundedness or abruptness that the tread surface transitions into the outer side surface and the inner side surface of the wheel. In particular, the tread surface is bordered by an outer edge adjacent the outer side surface and an inner edge adjacent the inner side surface. The outer and inner edges can be abrupt (typically 90°) or can be curved either with a small radius of curvature or relatively large radius of curvature. The abruptness of these edges influences the overall width of the tread surface which is contacting the ground. Also, this degree of roundedness influences an appearance of these prior art wheels somewhat.

The tread of prior art skateboard wheels is usually smooth. In some instances, such as with skateboard wheels provided by Birdhouse Projects, Inc. of Huntington Beach, Calif., and marketed under the "BIRDHOUSE" trademark, grooved urethane surface detail is provided to increase traction and decrease flatspotting. Such grooves are typically provided extending circumferentially with ten to twenty grooves on the tread surface and each groove being a fraction of a millimeter in depth. These grooves are so small that they quickly fill with dirt, tar and other road debris, such that the effect of such grooving on the tread of the wheel is limited.

Skateboard wheels, while varying slightly, have thus become rather standardized with the only variables being slight variations in diameter, slight variations in urethane hardness and some variations in the abruptness of the inside and outside edges of the tread surface. Accordingly, a need exists for skateboard wheels which depart more radically from standard prior art skateboard wheel configurations, to provide a superior ride, the potential for greater speed, greater mobility and responsiveness in turning, with less friction provided by the wheels so that overall ride smoothness is enhanced. Also, a need exists for skateboard wheels which have a more radically different appearance to allow skateboarders to have further avenues to express their distinctiveness through the way that their skateboards are outfitted.

SUMMARY OF THE INVENTION

With this invention, wheels are provided for use on a conveyance such as a skateboard which uniquely include a tread surface which is divided into a pair of crests spaced from each other by a circumferential trough therebetween. While the pair of crests and trough are preferably provided on a single wheel, and with four such similar single wheels mounted to a skateboard or other conveyance, it is also conceivable that the pair of crests can be provided on two separate wheels with the trough between the two crests defined by a gap between the two adjacent wheels. In such a configuration, a typical skateboard would include eight wheels with each of the eight wheels being matched with one other wheel to define the pairs of crests with troughs therebetween.

The trough depth is at least one millimeter deep, such that the trough does not contact an underlying support surface, but rather surface contact is provided only through the crests. Most preferably, the trough depth is between three and twelve millimeters with the trough depth most preferably approximately six millimeters. Preferably, the trough has a rounded minimum diameter point defining a bottom of the trough and rims defining where the trough borders the crests. These rims and minimum are all preferably curved when viewed in full front section.

Most preferably, the position of the trough is equidistant between the outer side surface and inner side surface of a body of the material (typically urethane) forming the wheel. This trough preferably has a substantially constant depth, constant width and parallel orientation between the outer side surface and inner side surface. Other features of the wheels of this invention are preferably similar to those of standard skateboard wheels, and can vary in all of the typical ways that skateboard wheels known in the prior art vary.

OBJECTS OF THE INVENTION

Accordingly, a primary object of the present invention is to provide skateboard wheels which include a circumferential trough within a tread surface thereof.

Another object of the present invention is to provide skateboard wheels which provide a superior ride to standard flat wheels.

Another object of the present invention is to provide skateboard wheels to enhance the performance of a skateboard.

Another object of the present invention is to provide wheels for a skateboard which are faster than skateboard wheels having a flat tread surface.

Another object of the present invention is to provide a skateboard wheel with a trough therein to exhibit greater handling responsiveness when turning a skateboard upon which a set of such wheels is mounted.

Another object of the present invention is to provide skateboard wheels which exhibit less friction and a smoother ride when compared to standard flat skateboard wheels.

Another object of the present invention is to provide skateboard wheels with a unique and attractive aesthetic appearance.

Another object of the present invention is to provide skateboard wheels which enhance the performance of a skateboard such that professional riders can achieve greater performance and greater competitive success when utilizing such wheels in competition.

Another object of the present invention is to enhance enjoyment for skateboarders by providing wheels with a circumferential trough therein for enhanced performance.

Other further objects of the present invention will become apparent from a careful reading of the included drawing figures, the claims and detailed description of the invention.

DESCRIPTION OF THE PREFERRED EMBODIMENT

Figure 4:
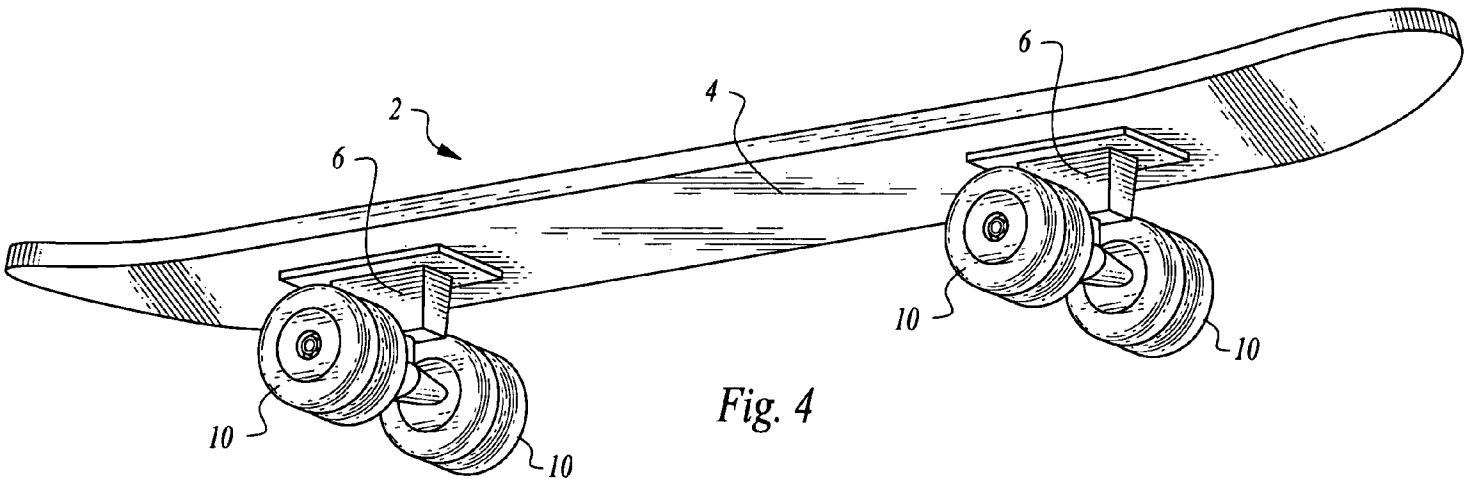
FIG. 4 is a perspective view of a skateboard with the wheels of this invention shown mounted upon the skateboard.

Referring to the drawings, wherein like reference numerals represent like parts throughout the various drawing figures, reference numeral 10 (FIG. 1) is directed to a wheel for use with a skateboard 2 or similar conveyance as one in a set of typically four wheels (FIG. 4). The wheel 10 uniquely includes a trough 50 within a tread surface 40 thereof such that the wheel 10 is provided with enhanced performance relative to wheels which lack such a trough.

Figure 1:
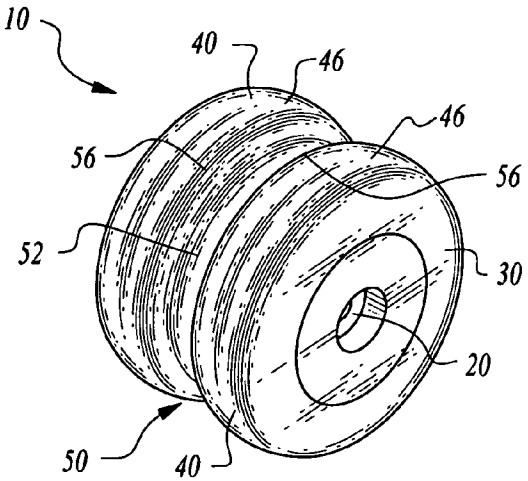
FIG. 1 is a perspective view of a troughed skateboard wheel according to this invention.

In essence, and with particular reference to FIG. 1, basic details of the wheel 10 of this invention are described. The wheel 10 is a generally solid rigid construct of generally cylindrical form. A bore 20 extends axially through the wheel 10 along a centerline about which the tread surface 40 is oriented. A generally solid body 30 is provided surrounding the bore 20 and upon which the tread surface 40 is supported. The body 30 is preferably a solid mass of material (typically urethane). The tread surface 40 is generally cylindrical in form and circumscribes the bore 20. The tread surface 40 defines a portion of the wheel 10 which is adapted to contact an underlying support surface in a rolling fashion when the skateboard or other conveyance supported by the wheel, is in contact with the surface during use. The trough 50 extends radially into the tread surface 40 and circumferentially around the body 30 of the wheel 10 so that the tread surface 40 is generally divided into a pair of crests 46 on either side of the trough 50.

More specifically, and with particular reference to FIG. 4, details of the skateboard 2, upon which the wheels 10 would typically be mounted, are described. The skateboard 2 includes a board 4 which is generally planar in form including an upper surface and a lower surface and with ends which typically angle upward slightly. The board 2 can vary in length and width.

A pair of trucks 6 are mounted to the lower surface of the board 4. These trucks 6 each support a pair of wheels 10 thereon. The wheels 10 of this invention are mounted to the trucks 6 in the same fashion that prior art wheels would typically be mounted to the trucks 6. In particular, an axle is provided on the truck 6 which has ends which are adapted to pass into the bores 20 of each wheel 10. The wheels 10 are thus rotatably supported upon the axles of the trucks 6 through the bores 20. A nut threads onto a top of the axle to capture the wheel 10 on the axle.

While this invention is particularly disclosed with regard to skateboards 2, any other wheeled conveyances utilizing similar wheels could be similarly adapted. For instance, rollerskates, in-line skates, motorized skateboards, scooters, and other conveyances could include the wheels 10 of this invention thereon.

Figure 3:
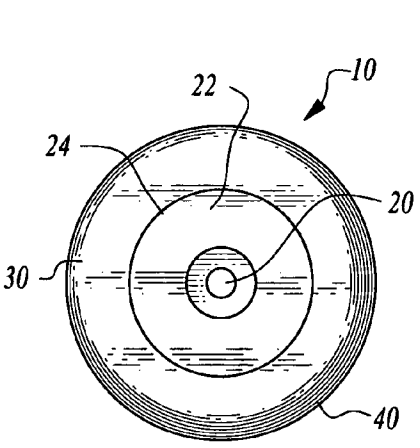
FIG. 3 is a side elevation view of that which is shown in FIG. 1.
Figure 2:
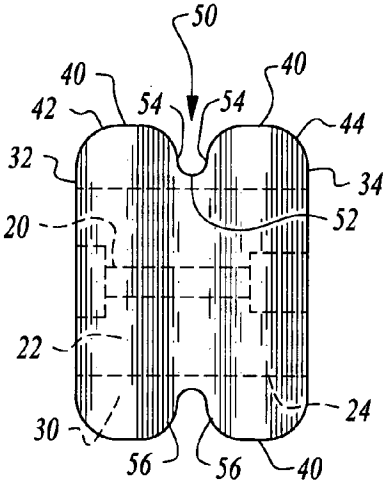
FIG. 2 is a front elevation view of that which is shown in FIG. 1 and with interior details of the wheel shown in broken lines.

With particular reference to FIGS. 1-3, particular details of the bore 20 and attachment structures for connecting the wheel 10 to the skateboard 2 (FIG. 4) are described. The bore 20 of the wheel 10 is preferably formed within a hub 22 defining a central generally axial portion of the wheel 10. Most preferably, the wheel 10 includes a bearing race 24 within the hub 22 and surrounding the bore 20. The bearing race 24 would typically include inner and outer races with ball bearings therebetween so that the outer race can rotate freely relative to the inner race. The inner race would thus be secured to the axle of the truck 6 of the skateboard 2 (FIG. 4) through the bore 20, and the outer race and other portions of the wheel 10 would rotate relative to the axle of the truck 6. Most particularly, the bearing race 24 would preferably mirror prior art skateboard wheel bearing races which typically include a pair of axially aligned sealed bearing races adjacent inner and outer sides of the wheel and with small washers outboard of each bearing. Alternatively, in place of the bearing race 24, the bore 20 can be merely a cylindrical bore through which the axle extends with a small amount of clearance between the axle and the bore 20. With such an arrangement, a more simplified rotational support is provided generally in the form of a journal bearing. Furthermore, other forms of bearings different from a ball bearing assembly or a journal bearing assembly could alternatively be provided, such as air bearings, lubricated bearings, solid lubricant bearings, and any other bearing suitable for mounting of wheels such as the wheel 10 onto an axle or other portion of the truck 6 or other support adapted to hold a wheel to the conveyance, such as the skateboard 2.

With particular reference to FIGS. 1-3, details of the body 30 of the wheel 10 are described. The body 30 is that portion of the wheel 10 extending from the bore 20 out to the tread surface 40. The body 30 is preferably a solid unitary mass of substantially rigid material. Most preferably, this material is some form of urethane. The hardness of the urethane can range similar to ranges exhibited in the prior art with measurements between durometer a 74 and durometer a 103.

The body 30 could alternatively be made out of other materials including plastics, wood and other cellulosic materials, metals, or rubber materials. Other materials might be developed in the future which could also be utilized to form the body 30 of the wheel 10 and still be used in accordance with this invention.

The body 30 is generally cylindrical in form with a generally circular outer side surface 32 parallel with and spaced from a generally circular inner side surface 34. These side surfaces 32, 34 are penetrated by the bore 20 and extend radially from the bore 20 out to the tread surface 40. These side surfaces 32, 34, and particularly the outer side surface 32 provides one location where decorative printing is typically provided which can be either merely surface painting or can have three dimensional relief extending out from the outer surface 32, depending on the aesthetic goals for decoration of the outer side surface 32. It is conceivable that the side surfaces 32, 34 could be interchangeable, or that the side surface 32, 34 are specifically required to remain on designated either inner or outer sides relative to the skateboard 2, or other conveyance. In some wheeled conveyance applications, the meaning of "outer" and "inner" may lose its significance (for instance with in-line skates). Hence, these terms "outer" and "inner" are merely provided as a convenience in distinguishing these two side surfaces 32, 34 from each other.

With particular reference to FIGS. 1-3, details of the tread surface 40 of the wheel 10 are described. The tread surface 40 provides the cylindrical outermost surface of the wheel 10 which defines the diameter of the wheel 10. The tread surface 30 is also that portion of the wheel 10 which is adapted to contact an underlying surface, such as a roadway, sidewalk or other underlying surface upon which the conveyance, such as the skateboard 2, is adapted to roll. The tread surface 40 is thus important in that the tread surface 40 plus the character of the underlying support surface help to define a coefficient of friction experienced between the wheel 10 and the underlying surface.

Other factors influence friction forces for the conveyance, in addition to the coefficient of friction. These friction factors include the hardness of the material forming the wheel 10 and particularly at the tread surface 40, the diameter of the wheel 10, the width of the tread surface 40, and the weight of the skateboard 2 or other conveyance, as well as the weight of the rider. These and other factors act together to determine what friction forces are experienced between the tread surface 40 and the underlying surface upon which the tread surface 40 is supported. In some instances it is desirable that friction forces be minimized. In other instances it is desirable that friction forces be increased. It is also important that friction forces that do exist exhibit a consistency and predictability so that the "ride" provided for the user can be anticipated. The user can thus expertly maneuver the skateboard 2 or other conveyance without encountering unexpected performance from the wheels 10. The tread surface 40 geometric characteristics have a great impact on the friction forces experienced by the wheel and hence the conveyance upon which the wheel is mounted.

The tread surface 40 includes an outer edge 42 and inner edge 44 defining opposite sides of the tread surface 40. The outer edge 42 defines a transition between the tread surface 40 and the outer side surface 32. The inner edge 44 defines a transition between the tread surface 40 and the inner side surface 34.

With this invention, the tread surface is divided into a pair of crests 46 which are each generally cylindrical circumscribing the wheel 10 on either side of the trough 50. While the crests 46 are preferably each a similar width to each other and maintain a constant width circumscribing the wheel 10, it is conceivable that the crests 46 could have widths which are different from each other and/or widths which vary as the crests 46 circumscribe the wheel 10. For instance, if the trough 50 is not aligned with a center of the tread surface 40, but rather is closer to the outer side surface 32 or the inner side surface 34, the crests 46 would have differing widths. Similarly, if the trough 50 were angled such that it were aligned within a plane non-parallel with the outer side surface 32 and inner side surface 34, the crests 46 would be wider in some areas and narrower in other areas. Most preferably, the trough has a constant width and a constant position equidistant between the side surfaces 32, 34, such that the crests 46 are identical in size, shape and orientation and maintain a constant width surrounding the wheel 10.

Alternatively, these geometric attributes of the crests 46 and trough 50 can vary. Variations include the trough 50 being variable in width or depth, the trough being non-parallel with the side surface 32, 34 and closer to one side 32 or the other 34.

The trough 50 defines a region on the tread surface which has a lesser diameter than the diameter exhibited by the crests 46 of the tread surface 40. In particular, the trough 50 is at least one millimeter below the crests 46, such that deflection of the material forming the tread surface 40 and the wheel 10 is insufficient to cause portions of the trough 50 to contact the underlying surface when the wheel 10 is contacting the surface. Rather, only the crests 46 contact the surface (except when exceptional surface anomalies are encountered, such as a piece of gravel on a roadway).

While the troughs 50 have at least a depth of one millimeter, most preferably the troughs have a depth of between three millimeters and twelve millimeters. This greatest range defines an overall range where performance is considered to be most adequate. A more precise range between five millimeters and ten millimeters of trough depth is considered to be most preferable, with a best mode for the trough 50 depth currently considered to be about six millimeters. Furthermore, a width of the trough 50 is considered to be adequate if provided between about three millimeters and twelve millimeters of width. More adequate performance is considered to be provided when the trough 50 width is between five millimeters and ten millimeters, with a most preferred trough width being about six millimeters.

The trough 50 can have various different cross-sectional shapes, but most preferably exhibits a generally constantly curving form between the two adjacent crests 46 (FIG. 2). In particular, a minimum 52 is provided defining a lowermost portion of the trough 50. This minimum 52 is concave in form extending up to inflection points 54 where curving of the surface forming the trough 50 changes from being concave outward from the wheel 10 to being concave inward toward the wheel 10. These inflection points 54 cause the surface to then round out to the crests 46 where rims 56 define edges of the trough 50 adjacent the crests 46. The rims 56 define a portion of the tread surface 40 where the trough 50 ends and the crest 46 begins, and where the tread surface 40 begins to contact an underlying surface. These rims 56 are preferably in the form of a gradual curve, but can alternatively be abrupt with a faceted edge having an angular measurement of 90° or more. It is also conceivable that the minimum 52 of the trough 50 could be flat or an abrupt "V" shape, rather than gradual.

While in the preferred embodiment shown herein the wheel 10 includes both the crests 46 and the trough 50, it is conceivable that this invention could be alternatively provided in the form of a pair of wheels replacing one of the wheels 10 of the preferred embodiment. In such an arrangement each substitute wheel would include a single crest and the trough would merely be the space between the adjacent substitute wheels. If such an arrangement were provided upon a skateboard, each of the trucks would include a pair of such substitute wheels with a trough therebetween on a first end of each truck and a pair of such substitute wheels with a trough therebetween on a second end of each truck. In such an arrangement eight substitute wheels would be provided on the skateboard 2 with each substitute wheel provided as one of a pair and with the trough between each of these pairs of substitute wheels. Such an arrangement could also be provided by merely taking the wheel 10 and deepening the trough 50 to a greater and greater depth so that the wheel 10 is essentially bisected by the trough 50.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A skateboard, comprising in combination:

a board having a top surface adapted to bear a rider thereon and a bottom surface opposite said top surface;

two trucks coupled to said bottom surface, each said truck including an elongate axle extending perpendicular to a direction of skateboard travel, said axle having two distal ends each distal end adapted to rollingly support a wheel thereon;

said axle supported by said truck at a point between said distal ends of said axle; and said wheels having a tread including a pair of crests spaced from each other by a circumferential trough, said trough having a lesser diameter than said crests, said crests being parallel with each other within each said wheel, said crests of a first said wheel adjacent a first distal end of said axle being parallel with said crests of a second wheel adjacent a second distal end and of said axle opposite said first end.

2. The skateboard of claim 1 wherein said trough is located equidistant between side edges of said at least one wheel.

3. The skateboard of claim 1 wherein said trough has a depth at least as great as about one millimeter.

* * * * *